US006571680B2

(12) United States Patent
Gardner

(10) Patent No.: US 6,571,680 B2
(45) Date of Patent: Jun. 3, 2003

(54) PNEUMATIC SHIFT RECIPROCATING PNEUMATIC MOTOR

(75) Inventor: Richard K. Gardner, Montpelier, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/841,680

(22) Filed: Apr. 24, 2001

(65) Prior Publication Data

US 2002/0152882 A1 Oct. 24, 2002

(51) Int. Cl.[7] ..... F01L 15/16
(52) U.S. Cl. ..... 91/298; 91/320; 91/323
(58) Field of Search ..... 91/225, 298, 320, 91/323; 92/183, 185

(56) References Cited

U.S. PATENT DOCUMENTS 95,225 A * 9/1869 Hayden ..... 91/298
5,586,480 A 12/1996 Gardner ..... 91/169

OTHER PUBLICATIONS

Parker Hannifin Corporation, Packing Division, Salt Lake City, Utah, Rod and Piston U–Packing Seals/Rod Wipers, Catalog No. 5225A USA, 43 pages.

* cited by examiner

*Primary Examiner*—F. Daniel Lopez
(74) *Attorney, Agent, or Firm*—Michael Best & Friedrich LLP

(57) ABSTRACT

A pneumatic motor having a motor body having a main piston chamber with opposed first and second chamber ends, at least two spool chambers in fluid communication with the main piston chamber, an inlet for flowing a pressurized fluid into each of the at least two spool chambers, and an outlet provided in the housing for exhausting the pressurized fluid from the main piston chamber and each of the spool chambers. At least two spool members are in the two spool chambers, with each spool member adapted to be movable in a first direction to permit pressurized fluid to be supplied to the main piston chamber and also in a second direction to permit the pressurized fluid to be exhausted from the main piston chamber. A piston member is movable in a reciprocating manner in the main piston chamber in response to movement by the spool members. The piston has first and second piston ends and an annular piston chamber located between and in fluid communication with the first and second chamber ends, the first and second piston ends defining, with the first and second chamber ends, a first chamber and a second chamber, respectively, in the main piston chamber during reciprocation of the piston. First and second seals between the piston ends and the annular piston chamber are provided such that while the piston reciprocates within the main piston chamber, the first and second seals alternately exhaust the first and second chambers into the annular piston chamber.

10 Claims, 6 Drawing Sheets

PNEUMATIC SHIFT RECIPROCATING PNEUMATIC MOTOR

BACKGROUND OF THE INVENTION

This invention generally relates to pneumatic motors, and more particularly to pneumatic shift reciprocating motors for pneumatic piston pumps.

Pneumatic shift reciprocating motors are known with an example being shown in commonly assigned U.S. Pat. No. 5,586,480, issued Dec. 24, 1996 to the inventor of the present invention, the disclosure of which is incorporated by reference herein. U.S. Pat. No. 5,586,480 discloses a pneumatic motor having a piston chamber with a major piston and two valve chambers having three-way spool valves located therein. Operation of the piston is accomplished by alternately connecting opposite ends of the piston chamber to a pressurized air inlet or to exhaust. Shifting of the three-way spool valves is accomplished pneumatically by air that is supplied to an annular piston chamber continuously throughout the motion of the piston. Because the annular piston chamber was always connected to an air supply, the length of the major piston was the length of the stroke length, thereby causing such pneumatic motors to have longer overall lengths. This in turn created a motor having a less compact design and having longer internal air passages located therein. Additionally, the three-way spool valves as constructed therein contained multiple component parts including seals and also internal air passages to supply air to the end of the spools. The foregoing illustrates limitations known to exist in present pneumatic devices. Thus it is apparent that it would be advantageous to provide an alternative directed to overcoming one or more of the limitations set forth above. Accordingly an alternative pneumatic motor is provided including the features more fully disclosed hereinafter.

SUMMARY OF THE INVENTION

A pneumatic motor having a motor body having a main piston chamber with opposed first and second chamber ends, at least two spool chambers in fluid communication with the main piston chamber, an inlet for flowing a pressurized fluid into each of the at least two spool chambers, and an outlet provided in the housing for exhausting the pressurized fluid from the main piston chamber and each of the spool chambers. At least two spool members are in the two spool chambers, with each spool member adapted to be movable in a first direction to permit pressurized fluid to be supplied to the main piston chamber and also in a second direction to permit the pressurized fluid to be exhausted from the main piston chamber. A piston member is movable in a reciprocating manner in the main piston chamber in response to movement by the spool members. The piston has first and second piston ends and an annular piston chamber located between and in fluid communication with the first and second chamber ends, the first and second piston ends defining, with the first and second chamber ends, a first chamber and a second chamber, respectively, in the main piston chamber during reciprocation of the piston. First and second seals between the piston ends and the annular piston chamber are provided such that while the piston reciprocates within the main piston chamber, the first and second seals alternately exhaust the first and second chambers into the annular piston chamber.

The foregoing and other aspects will become apparent from the following detailed description of the invention when considered in conjunction with accompanying drawing figures.

DETAILED DESCRIPTION OF THE DRAWINGS

DETAILED DESCRIPTION OF THE PREFERRED EMBODIMENTS

Figure 6:
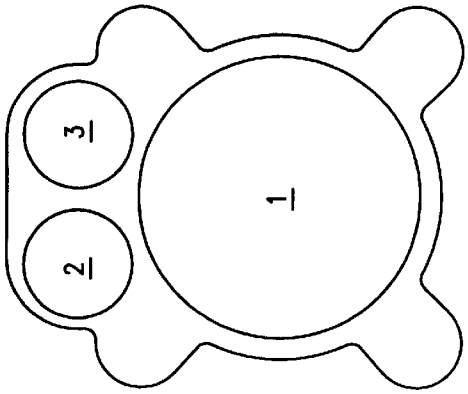
FIG. 6 is a top view of a motor body according to an embodiment of the present invention showing the main piston and spool chambers.

The invention is best understood by reference to the accompanying drawings in which like reference numbers refer to like parts. It is emphasized that, according to common practice, the various dimensions of the diaphragms and the associated pump parts as shown in the drawings are not to scale and have been enlarged for clarity. Moreover, as used herein, the term "up", "upward," "down," and "downward" are all taken with respect to the drawing figures as shown. Referring now to the drawings, FIG. 6 shows a top view of a motor housing of a first embodiment of a pneumatic motor according to the present invention. This motor includes a major cylinder having a bore that defines a piston chamber 1 and two minor cylinders that define spool chambers 2 and 3. The embodiments of the air motor of the present invention are generally similar in construction to that shown in U.S. Pat. No. 5,586,480, which patent is incorporated by reference herein with the differences with the embodiments of the present invention being described in greater detail below.

Turning to FIGS. 1–5, shown are partial schematic views of a longitudinal cross-sectional of the motor with its component parts according to a first preferred embodiment. For clarity, the spool chambers 2 and 3, which usually would be located side-by-side and share a single air inlet, are shown on opposite sides of the piston chamber 1 to show the operating relationship between the chambers and their component parts. The single air supply is provided by the same passage to chambers 2 and 3 with this supply being shown schematically to both chambers but described collectively as supply 101. Spool chambers 2 and 3 have passages 17 and 8, respectively, that are in fluid communication with piston chamber 1. Spool chambers 2 and 3 also have ports 12, 112, and 27, 25, respectively, that are in fluid communication with piston chamber 1. These ports, passages, and their operation will be described in greater detail below.

Shown in spool chambers 2 and 3 are spools 11 and 4, respectively. Spools 11 and 4 have large diameter ends with seals 13, 126, 102 and 28, 26, 7, respectively, that move into and out of engagement with their respective spool chambers as described in detail below. On the ends opposite the larger diameters, spools 11 and 4 have relatively smaller diameter ends with seals 14, 15 and 6, 5, respectively, around grooved portions 50 that form spool valves at the end of the small diameter ends of the spools. These spool valves move into and out of engagement with stepped portions located in their respective spool chambers to exhaust on their ends as described in detail below. By providing spools 11 and 4 each with large and small diameter ends, shifting is accomplished by the differential in the cross-sectional areas provided at these ends as described in detail below. Additionally, because air is supplied to the ends of the spools by porting described below, the need for internal air passages to supply air to the spool end as shown in the '480 patent is eliminated. It will be understood, that either type of spool may be incorporated, however, the spool taught by the '480 patent requires two additional internal passages. Also provided on spools 11 and 4 are passages 30 and 29, respectively, that channel air through the spools as described in greater detail below.

Head caps 35 and 40 are provided that close off the ends of the spool chambers containing the larger diameter ends of the spools 4 and 11 while leaving the exhaust ends of the spool chambers (i.e., the ends that contain the smaller diameter ends of the spools) at least partially open to atmosphere. Preferably, protuberances 45 are also provided to prevent the spool members from sticking during operation of the motor.

Figure 7:
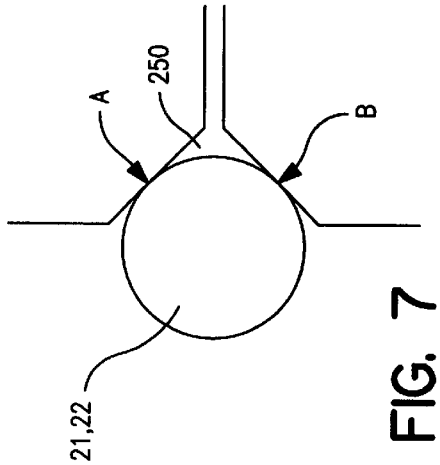
FIG. 7 is an enlarged perspective view illustrating directional check valves incorporating seals according to an embodiment of the present invention.

As shown in FIGS. 1–5, located within the piston chamber 1 is a piston 10 on which are provided seals 18 and 19 that are always sealed against the piston chamber 1 of the major cylinder and define chambers 9 and 16 and an annular piston chamber 20. Also provided on main piston 10 are seals 21 and 22 that are located in "V"-grooves located circumferentially around main piston 10 as shown in greater detail in FIG. 7. The "V"-grooves each provide two seal points shown as "A" and "B" in and define annular chambers 250 in which seals 21 and 22 respectively sit and act as check valves. The check valves provided by seals 21 and 22 are one-way valves that permit air passing from passages 23 and 24 into annular chambers 25 and 26 to pass into annular piston chamber 20 while they prevent reverse flow from annular piston chamber 20 due to the elasticity of the seal and pressure caused by the air pressure in annular piston chamber 20. This construction allows these seals to become unsealed and pass air at a low pressure since the effective area is the diameter of the seal, not the port. This is an improvement over prior art seals such as those used in paint sprayers that incorporate the use of a flat seal over a port and require more pressure to unseat the seal.

Figure 1:
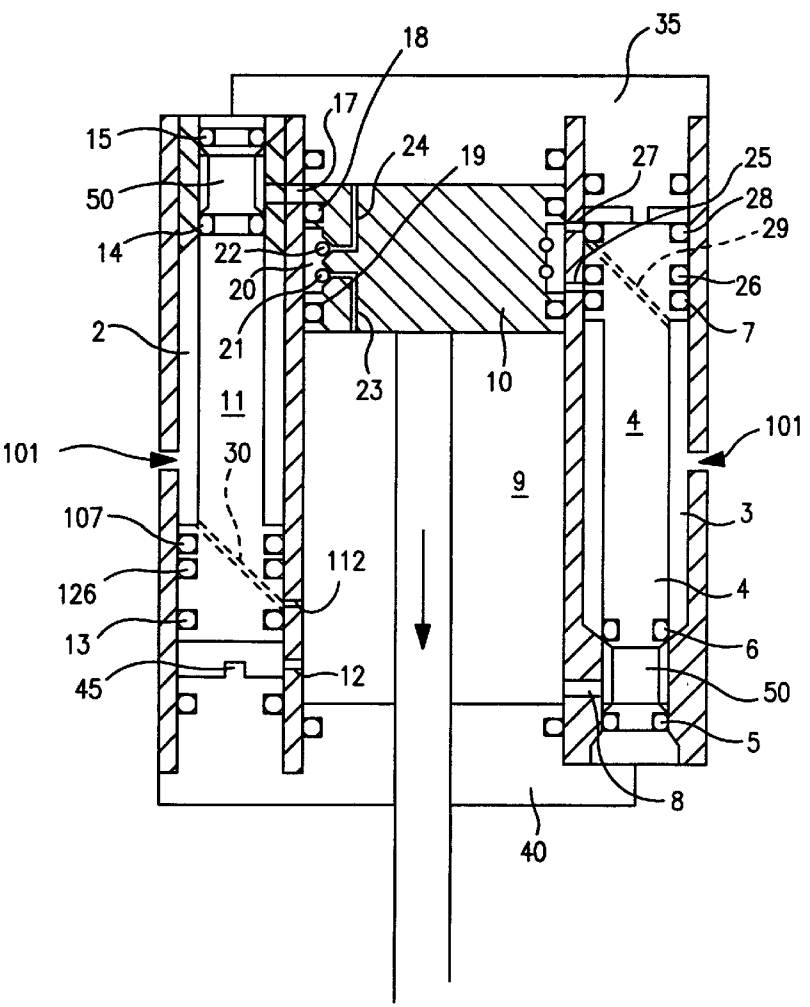

Operation of the motor shown in FIGS. 1–5 will now be described. Referring now to FIG. 1, air supply 101 (shown on both sides of the motor) provides air that fills spool chamber 2 and spool chamber 3. With respect to air passing into chamber 3, a seal 7 is provided having a larger diameter and, therefor, a larger effective surface area than seal 5 for the air to act on. As a result the pressure acting on the larger surface area of seal 7 generates a larger force that moves spool 4 up in chamber 3 to the position shown in FIG. 1. With spool 4 in this position, seal 5 and seal 7 on spool 4 seal against the sides and define chamber 3 as shown. Seal 6 does not seal in this position, however, and causes main piston 10 to move upward by permitting air from chamber 3 to enter chamber 9 through passage 8. Air passing into chamber 9 also passes through port 12 to force spool 11 upward to the position shown in FIG. 1. This upward force on spool 11 is generated because seal 13 is provided with a larger diameter and thus a larger effective surface area than seal 14 or seal 15.

Figure 2:
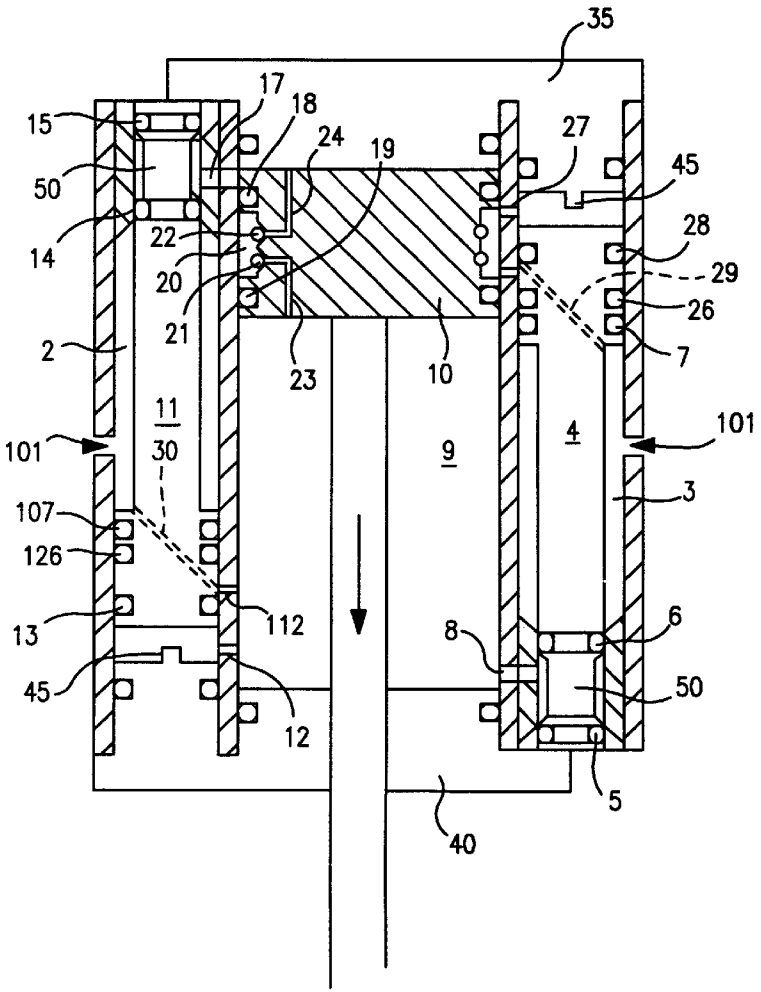
FIGS. 1–5 are partial schematic, cross-sectional views of a pneumatic motor according to an embodiment of the present invention moving through successive stages of a pumping stroke.
Figure 3:
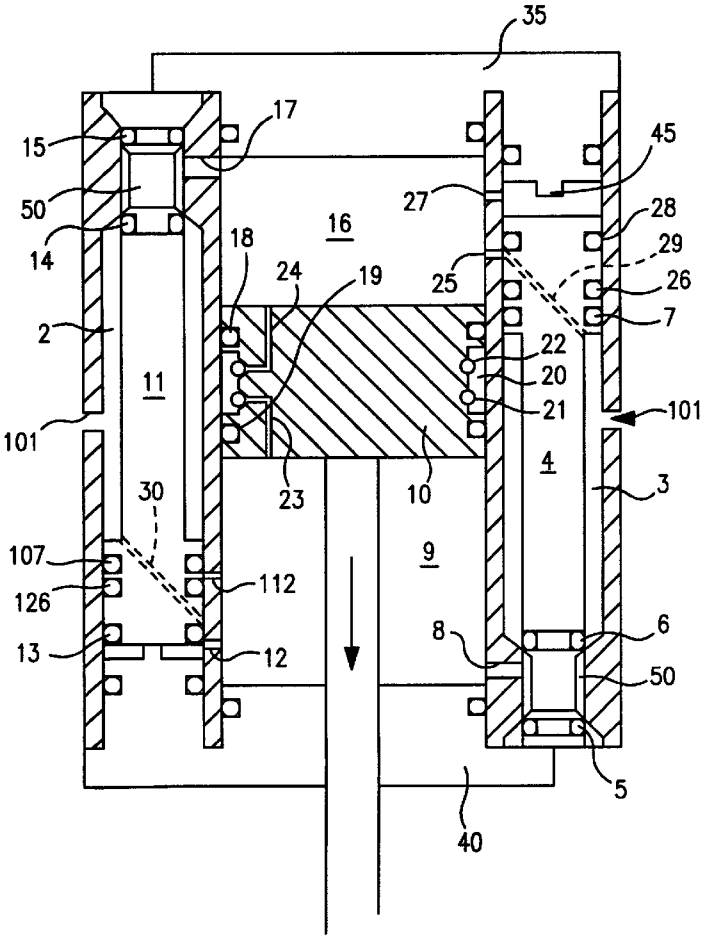

As main piston 10 approaches the fully upward position in FIG. 1, when seal 18 crosses port 25 the air in annular piston chamber 20 can go nowhere because port 25 is blocked by seals 26 and 7. When seal 18 crosses port 27 at the end of the stroke of main piston 10, however, air in chamber 9 enters via passage 23 across a one-way check valve formed by seal 21 into annular piston chamber 20. The air in annular piston chamber 20 then goes through port 27 and forces spool 4 down because seal 28 is larger than and provides a larger effective surface area than seal 5 or seal 6. As spool 4 moves down to the position shown in FIG. 2, seal 26 crosses over port 25 connecting air in chamber 3 to the top of spool 4 through passage 29, port 25, annular piston chamber 20 and port 27. Thus, in the fully downward position shown in FIG. 2, spool 4 is held down even when no air signal is supplied from chamber 9 through passage 23. Additionally, as shown in FIG. 2, when seal 6 contacts the walls of chamber 3, supply air to chamber 9 is disconnected from passage 8 and seal 5 no longer seals against chamber 3 thereby connecting chamber 9 to exhaust through passage 8 past seal 5. Because chamber 9 is connected to exhaust via passage 8, port 12 is also open to exhaust, so spool 11 is forced down (as shown in FIG. 3) by supply air entering chamber 2. With spool 11 moved to the downward position shown in FIG. 3, seal 14 no longer contacts chamber 2 and thereby permits supply air entering chamber 2 to pass through port 17 into chamber 16. Because port 8 is already connected to exhaust, major piston 10 is forced downward as shown in FIG. 3.

Figure 4:
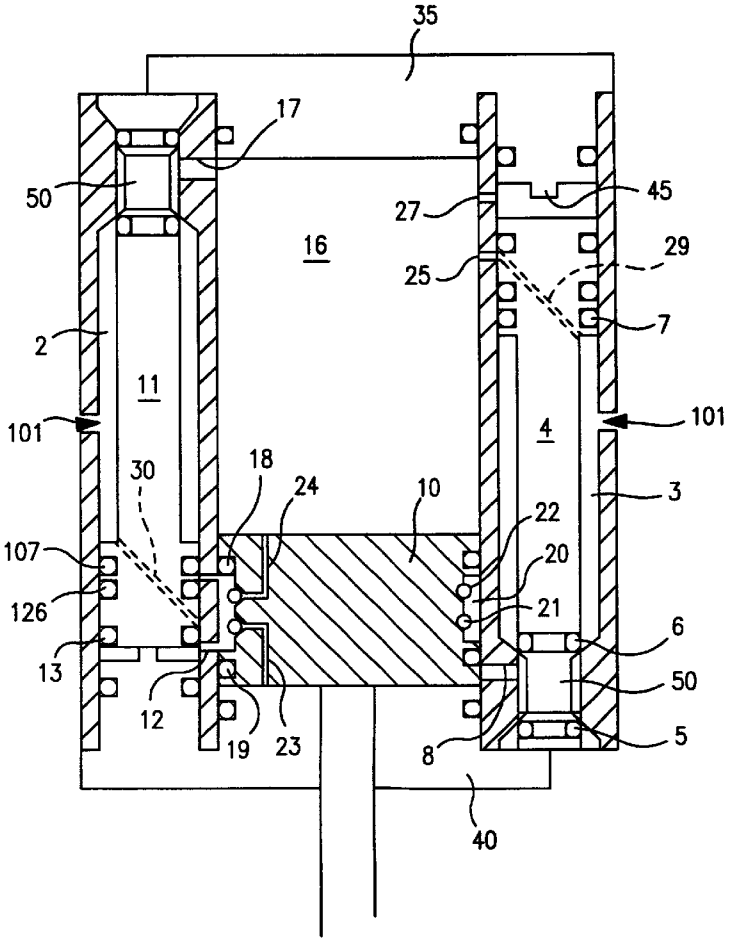
Figure 5:
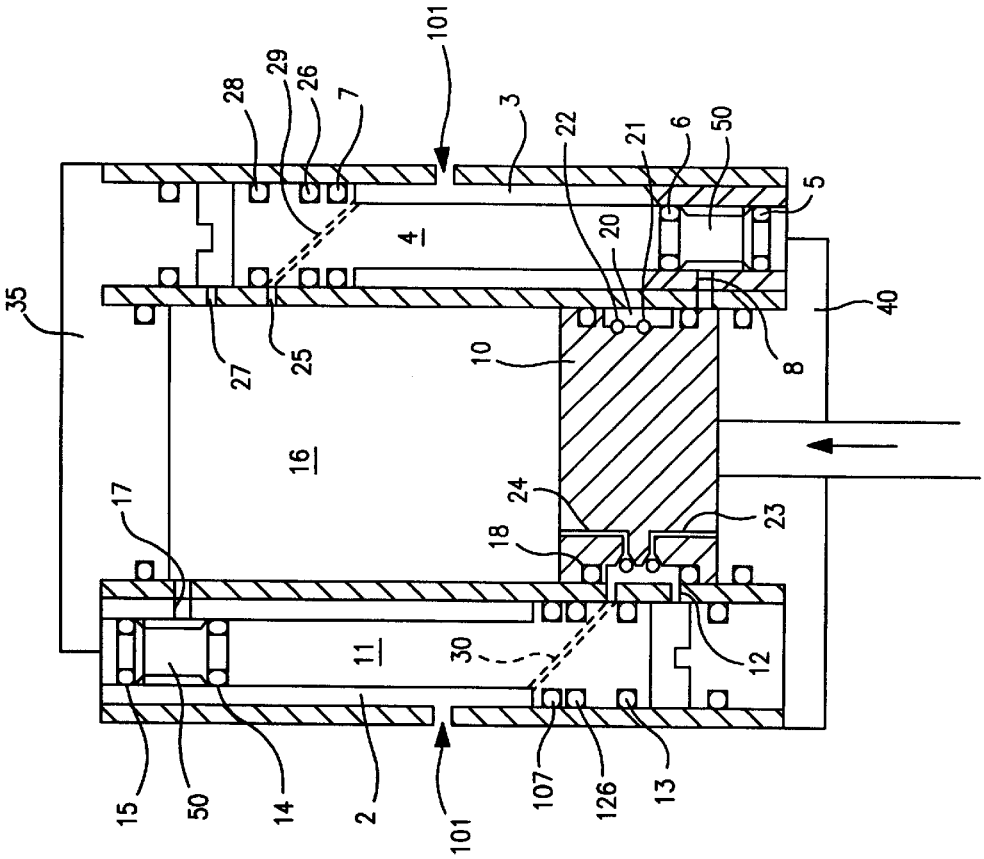

As main piston 10 approaches the fully downward position in FIG. 4, when seal 19 crosses port 112 the air in annular piston chamber 20 can go nowhere because port 112 is blocked by seals 126 and 102. When seal 19 crosses port 12 at the end of the stroke of main piston 10, however, air in chamber 16 enters via passage 24 across a one-way check valve formed by seal 22 into annular piston chamber 20. The air in annular piston chamber 20 then goes through port 12 and forces spool 11 up because seal 13 is larger than and provides a larger effective surface area than seal 14 or seal 15. As spool 11 moves up to the position shown in FIG. 5, seal 126 crosses over port 112 connecting air in chamber 2 to the bottom of spool 11 through passage 30, port 112, annular piston chamber 20 and port 12. Thus, in the fully upward position shown in FIG. 5, spool 11 is held up even when no air signal is supplied from chamber 16 through passage 24. Additionally, as shown in FIG. 5, when seal 14 contacts the walls of chamber 2, supply air to chamber 16 is disconnected from passage 17 and seal 15 no longer seals against chamber 2 thereby connecting chamber 16 to exhaust through passage 17 past seal 15. Because chamber 16 is connected to exhaust via passage 17, port 27 is also open to exhaust, so spool 4 is forced upward to the position shown in FIG. 1 by supply air entering chamber 3. With spool 4 moved to the upward position shown in FIG. 1, seal 6 no longer contacts chamber 3 and thereby permits supply air entering chamber 3 to pass through port 8 into chamber 9. Because port 17 is already connected to exhaust, major piston 10 is forced upward to the position shown in FIG. 1 and the cycle is repeated as described above. Piston 10 will continue to reciprocate up and down as long as there is an air supply provided.

Figure 11:
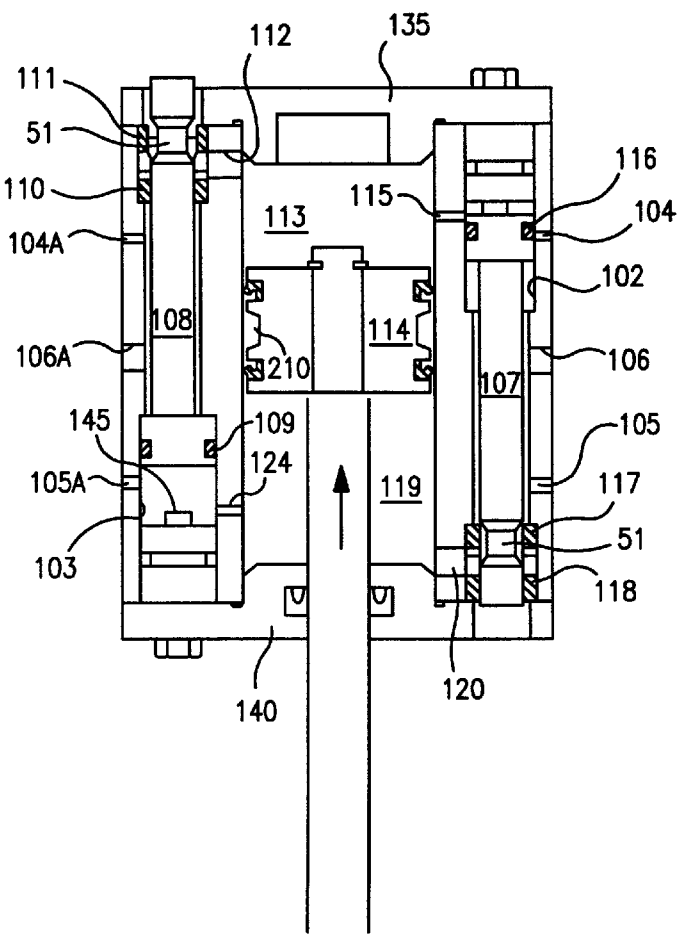
Figure 10:
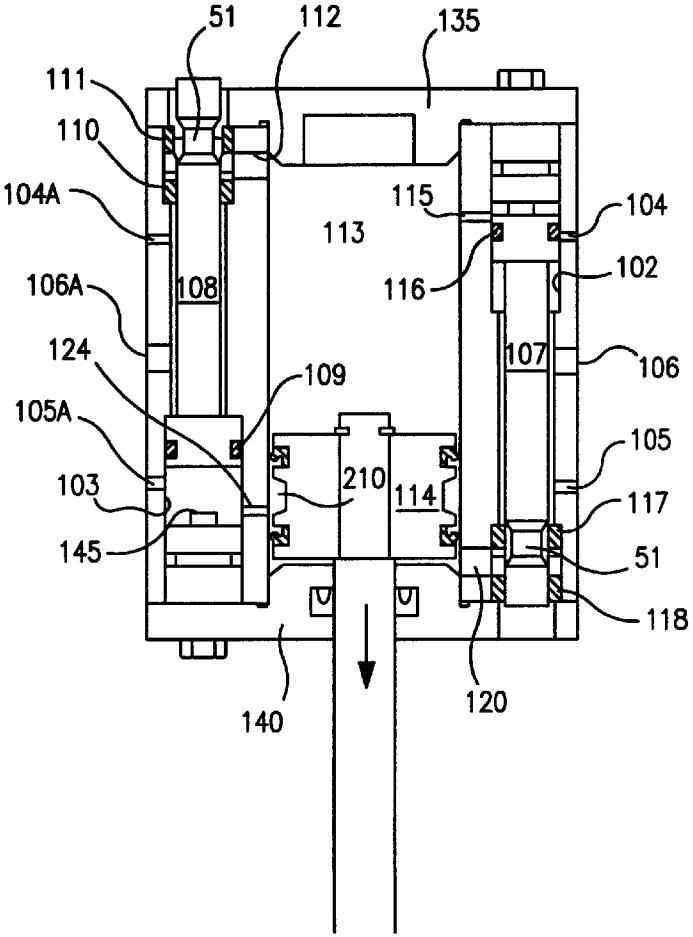
Figure 12:
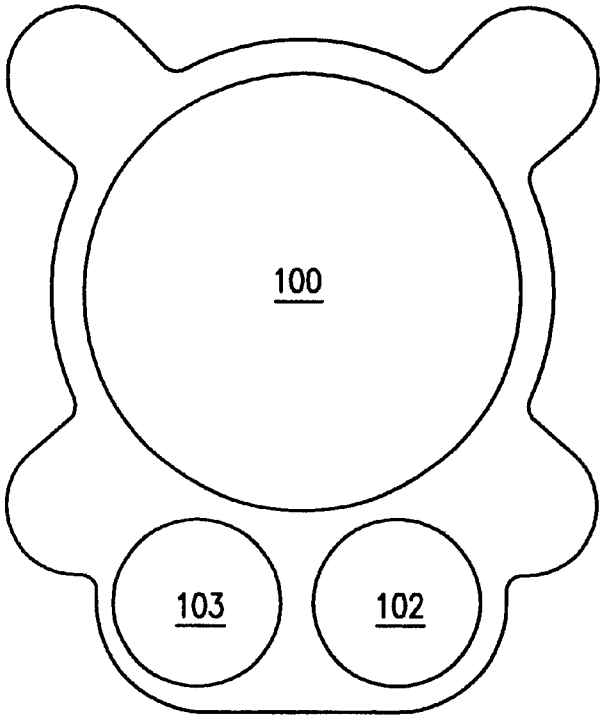
FIG. 12 is a top view of a motor body according to another embodiment of the present invention showing the main piston and spool chambers.

In yet another embodiment shown in FIGS. 8–11 are sequential schematic diagrams that show the operation of the motor housing shown in the top view in FIG. 12. The pneumatic motor is shown having a major cylinder having a bore that defines a piston chamber 100 and two minor cylinders that define spool chambers 102 and 103. The air motor is similar in construction to that shown and described above with respect to FIGS. 1–7 except that in addition to other features described further in detail below, generally, the spools do not contain any through passages, the main piston does not contain internal porting and the spool chambers are in fluid communication via two interconnecting passages. For clarity, the two interconnecting passages between chambers 102 and 103 are shown schematically and described with respect to these chambers as ports 104 and 104A (for the first passage) and ports 105 and 105A (for the second passage). Similarly, one air supply is provided by the same passage to chambers 102 and 103 with this supply being shown schematically and described as air supply 106 and 106A, respectively.

Turning to FIGS. 8–11, shown are partial schematic views of a longitudinal cross-sectional of the motor with its component parts shown sequentially in operation. For clarity, the spool chambers 102 and 103, which usually would be located side-by-side and share a single air inlet, are shown on opposite sides of the piston chamber 100 to show the operating relationship between the chambers and their component parts. Spool chambers 102 and 103 have passages 112 and 120, respectively, and ports 124 and 115, respectively, that are in fluid communication with piston chamber 100. These ports, passages, and their operation will be described in greater detail below.

Shown in spool chambers 102 and 103 are spools 107 and 108, respectively. Spools 107 and 108 have large diameter ends with seals 116 and 109, respectively, that move into and out of engagement with their respective spool chambers as described in detail below. On the ends opposite the larger diameters, spools 11 and 4 have relatively smaller diameter ends with grooved portions 50 that form spool valves at the end of the small diameter ends of the spools. These spool valves move into and out of engagement with seals located on the interior of their respective spool chambers to exhaust on their ends as described in detail below. By providing spools 107 and 108 each with large and small diameter ends, shifting is accomplished by the differential in the cross-sectional areas provided at these ends as described in detail below. Additionally, because air is supplied to the ends of the spools by porting described below, the need for internal air passages to supply air to the spool end as shown in the '480 patent is eliminated, although it will be understood, that the spool taught by the '480 patent may be incorporated with the two additional internal passages as taught in the '480 patent.

Head caps 135 and 140 are provided that close off the ends of the spool chambers containing the larger diameter ends of the spools 107 and 108 while leaving the exhaust ends of the spool chambers (i.e., the ends that contain the smaller diameter ends of the spools) at least partially open to atmosphere. Preferably, protuberances 145 are also provided to prevent the spool members from sticking during operation of the motor.

Figure 13:
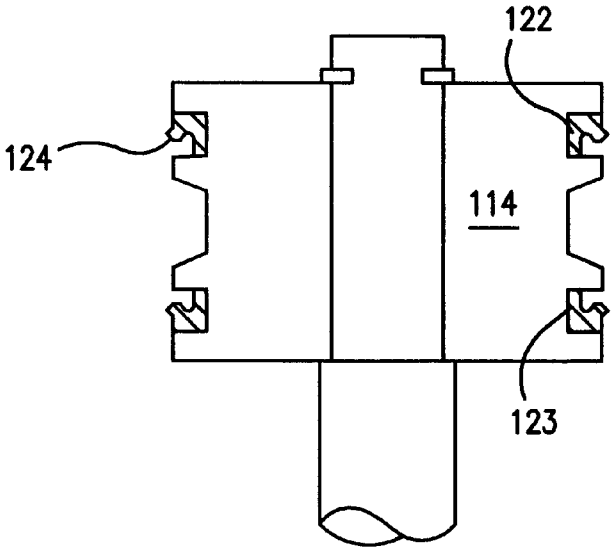
FIG. 13 is an enlarged perspective view illustrating a piston having directional check valves incorporating seals according to another embodiment of the present invention.

As shown in FIGS. 8–12, located within the piston chamber 100 is a piston 114 that divides the piston chamber into a chamber 113 located above the piston and a chamber 119 located below the piston. Piston 114 is provided with a large annular depression that forms an annular piston chamber 210 and has two additional depressions in which are provided unidirectional seals 122 and 123 that provide sealing in one direction. Preferably, these seals are "U"-Rings as shown in FIG. 13 having a lip 124 that does not seal in one direction. Most preferably seals 122 and 123 are non-symmetrical PARKER UR Series "U"-Rings having a back-beveled lip, which seals are available from the Packing Division of Parker Hannifin Corporation, Salt Lake City, Utah.

The dimensions of piston 114 are configured with its largest cross-sectional outer diameter being slightly smaller than the inner diameter of piston chamber 100 and so that when placed inside piston chamber 100, the back-leveled lip portions 124 contact the inner surface of piston chamber 100. This configuration permits air to pass through the one-way seals to annular piston chamber 210 as described below. As shown in FIG. 13, seals 122 and 123 are mounted to face each other so that during operation of the motor, when air enters into chamber 113 the back-beveled lip of seal 122 deflects inward to permit air to fill annular piston chamber 210 while the back-beveled lip of seal 123 deflects outward to engage the inner surface of piston chamber 100 thereby preventing air from passing into chamber 119. Similarly, when air enters into chamber 119 the back-beveled lip of seal 123 deflects inward to permit air to fill annular piston chamber 210 while the back-beveled lip of seal 122 deflects outward to engage the inner surface of piston chamber 100 thereby preventing air from passing into chamber 113. When moving in either direction, however, seals 122 and 123 prevent air from moving from annular piston chamber 210 into chambers 113 and 119, respectively.

Figure 8:
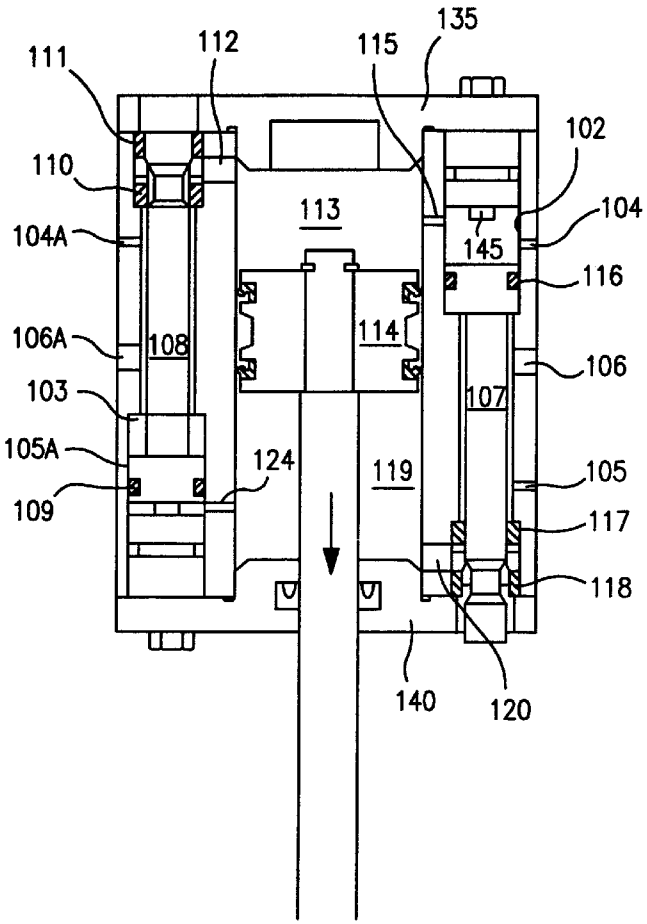

Operation of this alternative embodiment will now be described beginning with FIG. 8 in which air is provided via supply 106A enters into spool chamber 103 to act against seal 109 on spool 108, thereby holding it in a downward position as shown. Supply air from supply 106A travels past seal 110 through passage 112 to chamber 113 forcing piston 114 downward. Supply air in chamber 113 passes through port 115 and acts on seal 116 which is larger than seal 117 and 118, thereby forcing spool 107 down to the position shown. While in the downward position, spool 107 permits chamber 119 located under piston 114 to be vented to exhaust through passage 120 and past seal 118. When piston 114 is going down, air from chamber 113 causes seal 122 to open and seal 123 to close thereby permitting air to pass by seal 122 into annular piston chamber 210 while seal 123 prevents air from passing into chamber 119. Annular piston chamber 210 is thus filled by air passing between seals 122 and 123.

When piston 114 nears the bottom of its stroke, seal 123 crosses port 124 thereby connecting the bottom portion of spool chamber 103 beneath seal 109 to supply air passing sequentially from chamber 113, annular piston chamber 210, and through port 124. Because seal 109 is larger than seal 111, the supply air forces spool 108 upward to the position shown in FIG. 9, thereby disconnecting passage 112 from supply air and connecting port 112 to exhaust past seal 111. Prior to spool 108 reaching the fully upward position and before seal 110 seals against spool 108, however, as seal 109 passes port 105A the air supply from spool chamber 102 is connected to the bottom of spool 108 via port 105 thereby holding spool 108 upward even after the air supply from annular piston chamber 210 is stopped by seal 110 sealing against spool 108.

Figure 9:
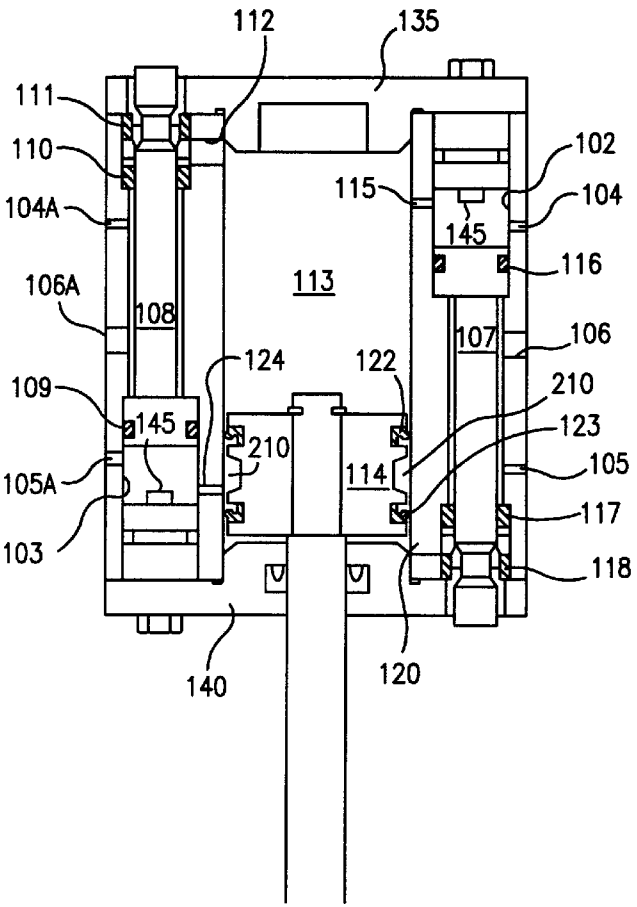
FIGS. 8–11 are partial schematic, cross-sectional views of a pneumatic motor according to another embodiment of the present invention moving through successive stages of a pumping stroke.

With spool 108 moved into the fully upward position shown in FIG. 9, chamber 113 is connected to exhaust through passage 112 and past seal 111. The top (larger diameter) portion of spool 107 is also connected to exhaust sequentially through port 115, chamber 113, and passage 112. Because the bottom side of seal 116 is always connected to air supply 106, spool 107 is forced up to the position shown in FIG. 10. In this position, the exhaust of chamber 119 through passage 120 is closed by seal 118 engaging spool 107 and opens chamber 119 to supply air by unsealing seal 117, thereby forcing piston 114 upward as shown in FIG. 11. As piston 114 changes direction and begins to moves upward, air from chamber 119 causes seal 123 to open and seal 122 to close thereby permitting air to pass by seal 123 into annular piston chamber 210 while seal 122 prevents air from passing into chamber 113. Annular piston chamber 210 is thus filled by air passing between seals 122 and 123.

As piston 114 nears the top of its stroke, seal 122 crosses port 115 thereby connecting the top portion of spool chamber 102 above seal 116 to supply air passing sequentially from chamber 119, annular piston chamber 210, and through port 115 to repeat the process. Thus, piston 114 will continue to reciprocate up and down as long as air is supplied to the air inlet.

Thus, by supplying an annular piston chamber with initial signal air supplied from either end of the piston through directional check valves, the present invention provides, inter alia, a pneumatic motor having a more compact design with a major piston that can be shorter in length than prior art motors. When the initial signal is stopped due to the valve shifting, the signal is maintained through the spool to the annular piston chamber between seals located on the major piston. Moreover, because the major piston does not have to be connected to air supply, the need for a center hole in the major cylinder can be eliminated. As a result, this valve lends itself to be a separate part and easily be attached to any cylinder. This becomes more apparent in larger diameter cylinders where multi-chamber extrusions become impractical.

While embodiments and applications of this invention have been shown and described, it will be apparent to those skilled in the art that many more modifications are possible without departing from the inventive concepts herein described. For example, although the present invention is shown and described with different piston arrangements, these pistons may be interchanged and used with the spool chamber configuration of the other. It is understood, therefore, that the invention is capable of modification and therefore is not to be limited to the precise details set forth. Rather, various modifications may be made in the details within the scope and range of equivalents of the claims without departing from the spirit of the invention.

Having described the invention, what is claimed is:

1. A pneumatic motor, comprising:

a) a motor body having a main piston chamber with opposed first and second chamber ends, two spool chambers in fluid communication with said main piston chamber, an inlet for flowing a pressurized fluid into each of the two spool chambers, an outlet provided in the housing for exhausting the pressurized fluid from said main piston chamber and each of the two spool chambers, wherein each spool chamber has a respective spool member located therein;

b) each spool member being adapted to be movable in a first direction to permit pressurized fluid to be supplied to said main piston chamber and also in a second direction to permit the pressurized fluid to be exhausted from said main piston chamber; and c) a piston member movable in a reciprocating manner in said main piston chamber in response to movement by said spool members within their spool chambers, said piston having i) a first piston end and a second piston end, said first and said second piston ends defining, with said first and said second chamber ends, a first chamber and a second chamber, respectively, in said main piston chamber during reciprocation of said piston;

ii) an annular groove along an outer periphery of the piston member between said first and second piston ends, said groove defining a movable annular piston chamber located in said main piston chamber between said first and said second chamber ends; and iii) a first piston passage connecting said annular piston chamber to said first chamber and a second piston passage connecting said annular piston chamber to said second piston chamber wherein said piston passages are internal bores located within said piston;

d) a first valve in said first piston passage and a second valve in said second piston passage, wherein said first and second valves are directional check valves that permit passage of air in only one direction into said annular piston chamber from said first and second chambers, respectively, such that while said piston reciprocates within said main piston chamber, said first valve and said second valve alternately exhaust said first and said second chambers into said annular piston chamber through first and second piston passages respectively, wherein said directional check valves comprise first and second "V"-shaped grooves located circumferentially around said annular piston chamber and in fluid communication with said internal bores in said piston with first and second "O"-rings seated in said "V"-shaped grooves.

2. The pneumatic motor according to claim 1, wherein said piston further comprises a first seal disposed on the periphery of said first piston end and a second seal disposed on the periphery of said second piston end, said first and second seals separating said annular piston chamber from said first and second chambers, respectively.

3. A pneumatic motor, comprising:

a) a motor body having a main piston chamber with opposed first and second chamber ends, two spool chambers in fluid communication with said main piston chamber, an inlet for flowing a pressurized fluid into each of the two spool chambers, an outlet provided in the housing for exhausting the pressurized fluid from said main piston chamber and each of the two spool chambers, wherein each spool chamber has a respective spool member located therein;

b) each spool member being adapted to be movable in a first direction to permit pressurized fluid to be supplied to said main piston chamber and also in a second direction to permit the pressurized fluid to be exhausted from said main piston chamber; and c) a piston member movable in a reciprocating manner in said main piston chamber in response to movement by said spool members within their spool chambers, said piston having i) a first piston end and a second piston end, said first and said second piston ends defining, with said first and said second chamber ends, a first chamber and a second chamber, respectively, in said main piston chamber during reciprocation of said piston, ii) an annular groove along an outer periphery of the piston member between said first and second piston ends, said groove defining a movable annular piston chamber located in said main piston chamber between said first and said second chamber ends, iii) a first piston passage connecting said annular piston chamber to said first chamber and a second piston passage connecting said annular piston chamber to said second piston chamber; and iv) a first seal disposed circumferentially on the periphery of said first piston end and a second seal disposed circumferentially on the periphery of said second piston end, said first and second seals separating said annular piston chamber from said first and second chambers, respectively, d) wherein said first seal forms a first value in said first piston passage and said second seal forms a second valve in said second piston passage, such that while said piston reciprocates within said main piston chamber, said first valve and said second valve alternately exhaust said first and said second chambers into said annular piston chamber through first and second piston passages respectively.

4. The pneumatic motor according to claim 3, wherein said first and second seals are directional check valves that permit passage of air in only one direction into said annular piston chamber from said first and second chambers, respectively.

5. The pneumatic motor according to claim 4, wherein said first and second seals are "U"-ring seals located on either said of said annular piston chamber with said "U"-shaped portions facing each other.

6. The pneumatic motor according to claim 5, wherein said piston passages are created alternately through said "U"-rings of said first and said second seal as air passes from said first and second chambers, respectively, to said annular piston chamber.

7. A pneumatic motor, comprising:

a) a motor body having a main piston chamber with opposed first and second chamber ends, two spool chambers in fluid communication with said main piston chamber each of said spool chambers having a closed end and an exhaust end that is at least partially open to exhaust through said motor body, an inlet for flowing a pressurized fluid into each of the two spool chambers, an outlet provided in the housing for exhausting the pressurized fluid from said main piston chamber and each of the two spool chambers, wherein each spool chamber has a respective spool member located therein;

b) each spool member having a large diameter end located proximate said closed end of its respective spool chamber and a small diameter end located proximate the exhaust end of its respective spool chamber, said large diameter end being greater in diameter than said small diameter end, and being adapted to be movable in a first direction to permit pressurized fluid to be supplied to said main piston chamber and also in a second direction to permit the pressurized fluid to be exhausted from said main piston chamber;

c) a piston member movable in a reciprocating manner in said main piston chamber in response to movement by each of said spools within their spool chambers, said piston having a first piston end and a second piston end and an annular groove along an outer periphery of the piston member between said first and second piston ends, said groove defining a movable annular piston chamber located in said main piston chamber between said first and said second chamber ends, said first and said second piston ends defining, with said first and said second chamber ends, a first chamber and a second chamber, respectively, in said main piston chamber during reciprocation of said piston; and d) a first piston seal between said first piston end and said annular piston chamber and a second seal between said second piston end and said annular piston chamber, such that while said piston reciprocates within said main piston chamber, said first seal and said second seal alternately exhaust said first and said second chambers into said annular piston chamber, wherein said small diameter ends of each of said spool members further comprise a spool valve portion and said exhaust ends of each of said spool chambers further comprise a reduced diameter portion such that when each spool member is moved in said first direction toward said closed end, said spool valve portion shifts in said reduced diameter portion of said exhaust end, thereby connecting said main piston chamber to said spool chamber via a port between said spool chamber and said main piston chamber, and when each spool member is moved in said second direction away from said closed end, said spool valve portion shifts in said reduced diameter portion of said exhaust end to connect said main piston chamber to said exhaust end via said port between said spool chamber and said main piston chamber, and wherein each of said spool members further comprises a passageway extending from a first opening located at an intersection point between said small diameter end and said large diameter end of said spool member, passing internally through and toward said large diameter end, to a second opening located in a periphery of said larger diameter end; and a port that connects said spool chamber with said main piston chamber, said port being located such that when said spool member is moved into said second direction away from said closed end, said second opening is aligned with said port thereby connecting said spool chamber surrounding said second smaller diameter end with said main piston chamber.

8. The pneumatic motor according to claim 7, further comprising seals adjacently disposed on said large diameter end such that when said spool member is moved into said first direction toward said closed end, said second opening is closed by said seals on said large diameter end.

9. The pneumatic motor according to claim 7, wherein said body has a first end and a second end and further comprising a first end cap on said first end and a second end cap on said second end, wherein said exhaust ends of said spool chambers are formed by openings in said first and second ends.

10. The pneumatic motor according to claim 9, wherein each of said end caps includes a protuberance which is adapted to be located in said closed ends of said spool chambers when said end caps are seated on said body ends.

* * * * *

UNITED STATES PATENT AND TRADEMARK OFFICE

CERTIFICATE OF CORRECTION

PATENT NO. : 6,571,680 B2
DATED : June 3, 2003
INVENTOR(S) : Richard K. Gardner

It is certified that error appears in the above-identified patent and that said Letters Patent is hereby corrected as shown below:

Column 9,
Line 5, delete "value" and insert -- valve --.

Signed and Sealed this

Fifteenth Day of July, 2003

JAMES E. ROGAN
*Director of the United States Patent and Trademark Office*